US010715935B2

(12) United States Patent
Andersen et al.

(10) Patent No.: US 10,715,935 B2
(45) Date of Patent: Jul. 14, 2020

(54) HEARING INSTRUMENT COMPRISING A MAGNETIC INDUCTION ANTENNA

(71) Applicant: GN HEARING A/S, Ballerup (DK)

(72) Inventors: Kim Fälling Andersen, Ballerup (DK); Nikolaj Peter Brunvoll Kammersgaard, Ballerup (DK)

(73) Assignee: GN HEARING A/S, Ballerup (DK)

( * ) Notice: Subject to any disclaimer, the term of this patent is extended or adjusted under 35 U.S.C. 154(b) by 0 days.

(21) Appl. No.: 16/185,942

(22) Filed: Nov. 9, 2018

(65) Prior Publication Data

US 2019/0208336 A1 Jul. 4, 2019

(30) Foreign Application Priority Data

Dec. 29, 2017 (EP) ..... 17211040

(51) Int. Cl.
*H04R 25/00* (2006.01)

(52) U.S. Cl.
CPC ..... *H04R 25/554* (2013.01); *H04R 25/505* (2013.01); *H04R 25/558* (2013.01); *H04R 2225/51* (2013.01); *H04R 2225/55* (2013.01)

(58) Field of Classification Search
CPC .... H04R 25/50; H04R 25/505; H04R 25/552; H04R 25/554; H04R 25/558; H04R 2225/51; H04R 2225/55
USPC ..... 381/23.1, 312, 314, 315, 316, 331; 455/11.1, 41.1, 106
See application file for complete search history.

(56) References Cited

U.S. PATENT DOCUMENTS 6,639,990 B1 * 10/2003 Astrin ..... H04R 25/558 381/312
8,498,434 B2 * 7/2013 Andersen ..... H04L 27/14 381/312
2012/0002830 A1 * 1/2012 Solum ..... H04R 25/554 381/315

FOREIGN PATENT DOCUMENTS

EP 1 777 644 A1 4/2007
WO WO 95/01678 1/1995

OTHER PUBLICATIONS

European Extended Search Report and Search Opinion dated Jun. 4, 2018 for Corresponding European Application No. 17211040.5.

* cited by examiner

*Primary Examiner* — Huyen D Le
(74) *Attorney, Agent, or Firm* — Vista IP Law Group, LLP

(57) ABSTRACT

A hearing instrument includes: a microphone; a signal processor configured to compensating a hearing loss of a user; a speaker configured to provide an output sound signal; a wireless communication unit comprising an oscillator circuitry, the oscillator circuitry having an antenna resonator configured to emit an electromagnetic field at a first frequency and a driving circuit configured to provide a driving circuit output; the driving circuit output comprising: a first sequence of pulses having a first phase and a first pulse width, and a second sequence of pulses having a second phase and a second pulse width, the second phase being phase shifted with respect to the first phase, the first phase and the second phase being based on the first frequency; the oscillator circuitry being configured to obtain the first sequence of pulses and the second sequence of pulses for excitation of the antenna resonator.

20 Claims, 7 Drawing Sheets

HEARING INSTRUMENT COMPRISING A MAGNETIC INDUCTION ANTENNA

RELATED APPLICATION DATA

This application claims priority to, and the benefit of, European Patent Application No. EP 17211040.5 filed on Dec. 29, 2017. The entire disclosure of the above application is expressly incorporated by reference herein.

TECHNICAL FIELD

The present disclosure relates to hearing instruments, such as hearing instruments for compensating a hearing loss of a user, such hearing instruments providing audio to a user, and particularly to hearing instruments having wireless communication capabilities, such as hearing instruments including an magnetic induction antenna, and particular to hearing instruments comprising magnetic induction antennas for communication, and particularly for hearing instruments efficiently driving a magnetic induction antenna.

BACKGROUND

Hearing instruments of any kind have over the later years been increasingly able to communicate with the surroundings, including communicating with remote controls, spouse microphones, other hearing instruments and lately also directly with smart phones and other external electronic devices.

Hearing instruments are very small and delicate devices and to fulfil the above requirements, the hearing instruments need to comprise many electronic and metallic components contained in a housing small enough to fit in the ear canal of a human or behind the outer ear. The many electronic and metallic components in combination with the small size of the hearing instrument housing impose high design constraints on any antennas to be used in hearing instruments with wireless communication capabilities.

Radio frequency antennas have been used in hearing instruments to achieve connectivity with a wide range of devices. However, also magnetic induction antennas are being used in hearing instruments. Hearing instruments are supplied with power from hearing instrument batteries, having a limited power supply, and for the users, longer lifetime or longer time-between-charging for such hearing instrument batteries is expected, even when the capabilities of the hearing instruments are improved. The hearing instrument comprises a number of electronic components, which are all supplied with power from the battery. Thus, optimization of power usage is a concern for all electronic components in the hearing instrument, and particular wireless communication may consume significant power. Therefore, for antennas in hearing instruments in general, there is a need to ensure that the antennas and the communication protocols are designed to reduce the power consumption while maintaining a high efficiency.

In some scenarios, magnetic induction antennas may be preferred due to e.g. increased efficiency, minimized absorption by the head, etc. However, there is a need to optimize power consumption for driving magnetic induction antennas.

SUMMARY

It is an object of some embodiments of the present disclosure to provide a hearing instrument with wireless communication capabilities using a magnetic induction antenna.

It is another object of some embodiments of the present disclosure to provide a hearing instrument having a low power antenna resonator.

In accordance with an aspect of the present disclosure a hearing instrument is provided. The hearing instrument comprises a signal processor and a wireless communication unit connected to the signal processor for wireless communication. The wireless communication unit is configured to inductively transmit and receive an electromagnetic field. The wireless communication unit comprises an oscillator circuitry comprising an antenna resonator and signal control switches; the antenna resonator being configured to transmit an electromagnetic field at a first frequency. The antenna resonator may include an inductor and a capacitor. The wireless communication unit further comprises a driving circuit for the oscillator circuitry, wherein the driving circuit provides a driving circuit output. The driving circuit output comprises in some embodiments a first sequence of pulses, the first sequence of pulses having a first phase and a first pulse width, and a second sequence of pulses, the second sequence of pulses having a second phase and a second pulse width, the second phase being phase shifted with respect to the first phase. The first phase and the second phase are determined based on the first frequency. The driving circuit output is provided to the oscillator circuitry to supply power to the antenna resonator for excitation of the antenna resonator.

According to another aspect, a method of operating a hearing instrument is provided. The hearing instrument comprises a signal processor and a wireless communication unit connected to the signal processor for wireless communication, the wireless communication unit being configured to inductively transmit and receive an electromagnetic field. The wireless communication unit comprises an oscillator circuitry comprising an antenna resonator and signal control switches, the antenna resonator being configured to transmit an electromagnetic field at a first frequency, and a driving circuit for the oscillator circuitry, the method comprising generating by the driving circuit a driving circuit output. In some embodiments, the driving circuit output comprises a first sequence of pulses, the first sequence of pulses having a first phase and a first pulse width, and a second sequence of pulses, the second sequence of pulses having a second phase and a second pulse width, the second phase being phase shifted with respect to the first phase, the first phase and the second phase being determined based on the first frequency. The driving circuit output is provided to the oscillator circuitry. By the driving circuit output, power may be supplied to the signal control switches and the antenna resonator.

In accordance with a further aspect of the present disclosure a wireless communication unit is provided. The wireless communication unit is configured for wireless communication and is configured to receive a signal, such as a data signal, such as a data communication signal, from e.g. a signal processor. The wireless communication unit is configured to inductively transmit and receive an electromagnetic field. The wireless communication unit comprises an oscillator circuitry comprising an antenna resonator and signal control switches; the antenna resonator being configured to transmit an electromagnetic field at a first frequency. The antenna resonator may include an inductor and a capacitor. The wireless communication unit further comprises a driving circuit for the oscillator circuitry, wherein the driving circuit provides a driving circuit output. The driving circuit output comprises in some embodiments a first sequence of pulses, the first sequence of pulses having a first phase and a first pulse width, and a second sequence of pulses, the second sequence of pulses having a second phase and a second pulse width, the second phase being phase shifted with respect to the first phase. The first phase and the second phase are determined based on the first frequency. The driving circuit output is provided to the oscillator circuitry to supply power to the antenna resonator. The driving circuit output is provided to the oscillator circuitry for excitation of the antenna resonator According to a still further aspect, a method of operating a wireless communication unit is provided. The wireless communication unit is configured for wireless communication, and is configured to receive a signal, such as a data signal, such as a data communication signal, from e.g. a signal processor. The wireless communication unit is configured to inductively transmit and receive an electromagnetic field. The wireless communication unit comprises an oscillator circuitry comprising an antenna resonator and signal control switches, and a driving circuit for the oscillator circuitry, the antenna resonator being configured to transmit an electromagnetic field at a first frequency, the method comprising generating by the driving circuit a driving circuit output. In some embodiments, the driving circuit output comprises a first sequence of pulses, the first sequence of pulses having a first phase and a first pulse width, and a second sequence of pulses, the second sequence of pulses having a second phase and a second pulse width, the second phase being phase shifted with respect to the first phase, the first phase and the second phase being determined based on the first frequency. The driving circuit output is provided to the oscillator circuitry. By the driving circuit output, power may be supplied to the signal control switches and the antenna resonator. The antenna resonator transmits the electromagnetic field at the first frequency.

In some embodiments, the hearing instrument comprises a microphone for reception of sound and conversion of the received sound into a corresponding first audio signal, a signal processor for processing the first audio signal into a second audio signal compensating a hearing loss of a user of the hearing aid, and a speaker connected to an output of the signal processor for converting the second audio signal into an output sound signal.

It is an advantage that the antenna resonator is driven efficiently, such that the antenna resonator has a low power consumption during use. It is an advantage that by supplying power to the antenna resonator for excitation of the antenna resonator using a first sequence of pulses, such as using a first and a second sequence of pulses, the second sequence of pulses having a frequency which is phase shifted with respect to the phase of the first sequence of pulses, power consumption of the antenna resonator may be reduced.

In some embodiments, the signal processor is connected to the driving circuit and configured to provide a signal, such as a data signal, such as a data communication signal, such as a digital data signal, to the driving circuit. The driving circuit is configured for digital modulation of the signal received from the signal processor. The digital modulation may be any digital modulation, such as digital modulation based on keying and may output a modulated signal. In some embodiments, the digital modulation is a frequency modulation, such as frequency-shift keying. In some embodiments, the digital modulation is an amplitude modulation, such as amplitude-shift keying. In some embodiments, the digital modulation is a phase modulation, such as phase-shift keying. The data may thus be conveyed by modulating the phase of a carrier wave or reference signal. The phase-shift keying, PSK, may be any type of phase-shift keying, including binary phase-shift keying, BPSK, quadrature phase-shift keying, QPSK, differential phase-shift keying, DPSK, higher order phase-shift keying, and/or any combinations or derivatives of these modulation methods. The driving circuit may comprise any components as known by a skilled person to implement the digital modulation, including one or more of clock generators, pulse generators and/or modulators.

In some embodiments, the driving circuit further comprises a splitter and/or a phase shifter to split and phase shift the modulated signal to thereby obtain a driving circuit output comprising a first sequence of pulses having a first phase and a first pulse width, and a second sequence of pulses having a second phase and a second pulse width, wherein the second phase is being phase shifted with respect to the first phase. It is emphasized that a splitter and/or phase shifter are optional elements, and that a driving circuit output having a single sequence of pulses having a first phase and a first pulse width may be provided to the oscillator circuitry to supply power to the antenna resonator for excitation of the antenna resonator.

In some embodiments, the second phase is phase shifted 180° with respect to the first phase. It is an advantage of having a 180° phase shift. In some embodiments, the second phase is shifted with 0, 90°, 180° or 270° with respect to the first phase. It should be emphasized that the phase shifts indicated may be approximate phase shifts and that each phase shift may vary with +/−10%.

In some embodiments, the first pulse width and the second pulse width of the driving circuit output are determined with respect to the first frequency. The first pulse width and/or the second pulse width may be ¼ of the first frequency, such as ⅙ of the first frequency, such as ⅛ of the first frequency. The first pulse width and/or the second pulse width may be less than ¼ of the first frequency, such as less than ⅙ of the first frequency, such as less than ⅛ of the first frequency. The first pulse width and/or the second pulse width may be between ¼ of the first frequency and 1/100 of the first frequency, such as between ¼ of the first frequency and 1/10 of the first frequency, such as between ¼ of the first frequency and ⅛ of the first frequency, such as approximately ⅙ of the first frequency.

In some embodiments, the first pulse width and the second pulse width are fixed pulse widths, and in some embodiments, the first pulse width and the second pulse width is the same, such as substantially the same, such as of a same magnitude.

In some embodiments, the first sequence of pulses has a first period and the second sequence of pulses has a second period, the first period and the second period being determined as a fraction of the inverse of the first frequency. The first period and the second period may be the inverse of the first frequency, such as $1/f_1$, where $f_1$ is the first frequency. The first period and the second period may be between $1/f_1$ and one hundredth of $1/f_1$, such as between one fourth of $1/f_1$ and one hundredth of $1/f_1$, such as between one tenth of $1/f_1$ and one hundredth of $1/f_1$, between one fourth of $1/f_1$ and one tenth of $1/f_1$, such as between one sixth of $1/f_1$ and one tenth of $1/f_1$, such as about one sixth of $1/f_1$. The first period and the second period may be a same period.

In some embodiments, the energy density of the driving circuit output is determined at least partly by the first pulse width and the second pulse width and/or the energy density of the driving circuit output is determined at least partly by the amplitude of the first sequence of pulses and the amplitude of the second sequence of pulses, or any combination thereof. Thus, increasing the pulse width or increasing the amplitude of the first pulses and the second pulses, respectively, increases the energy density of the driving circuit output. Likewise, decreasing the pulse width or decreasing the amplitude of the first and second pulses, respectively, decreases the energy density of the driving circuit output. Hereby, any changes of the pulse width, such as of the pulse width magnitude, and/or of the pulse amplitude, such as of a pulse amplitude magnitude, will change the energy density of the driving circuit output.

In some embodiments, the pulses in the first sequence of pulses have a first constant amplitude, and the pulses of the second sequence of pulses have a second constant amplitude. The first constant amplitude may correspond to the second constant amplitude, such that the first constant amplitude and the second constant amplitude may have the same constant amplitude, such as the same constant amplitude having a same magnitude.

In some embodiments, the antenna resonator being configured to inductively transmit and receive an electromagnetic field is a magnetic induction antenna. The antenna resonator may comprise a resonant circuit. The antenna resonator may comprise an inductor and a capacitor, the inductor and the capacitor forming an oscillating circuit, such as a resonant circuit. The antenna resonator is configured to be driven by the driving circuit output. The antenna resonator has a resonant frequency, i.e. corresponding to the first frequency, being determined by the inductive reactance magnitude and the capacitive reactance magnitude of the antenna resonator. Tuning of the inductive reactance magnitude and the capacitive reactance magnitude of antenna resonator may thus tune the resonance frequency and thereby the first frequency. Likewise, changes to the resonance frequency may be implemented by tuning the inductive reactance magnitude and the capacitive reactance magnitude of the antenna resonator.

In some embodiments, the antenna resonator comprises an inductor and a capacitor provided in parallel. In some embodiments, the antenna resonator comprises an inductor and a capacitor provided in series. The configuration providing the optimum properties for a specific use may be selected.

Inherently, the antenna resonator will not be a loss-less antenna resonator, rather a loss resulting from small but non-zero resistance within the components and connecting wires will be present. The presence of resistance in the oscillating circuit will dampen the oscillations of the oscillating circuit. The driving circuit is configured to overcome the loss to ensure continuous oscillation at the resonance frequency. Typically, the antenna resonator will be designed having a high Q-factor, and thus low loss, to minimize the power or energy density required to ensure continuous oscillation.

In some embodiments, the first frequency, and thus the resonance frequency of the antenna resonator is between 1 MHz and 20 MHz, such as between 6 MHz and 14 MHz, such as about 6.7 MHz, such as about 13.6 MHz. The resonance frequency may be selected as a resonance frequency of an ISM band. The inductive transmission is a short-range communication and the range of the transmitted electromagnetic field is typically below 1 meter.

In some embodiments, the antenna resonator has a first input terminal and a second input terminal. For a parallel implemented antenna resonator, the first input terminal may be provided at a first connection between the capacitor and the inductor, and the second input terminal may be provided at the second connection, parallel to the first connection, between the capacitor and the inductor. For an antenna resonator implemented in series, the first input terminal may be an input to the inductor and the second input terminal may be an input to the capacitor, or vice versa.

In some embodiments, the driving circuit output is provided to the first input terminal and to the second input terminal via the signal control switches. In some embodiments, the driving circuit output is provided to the first input terminal or to the second input terminal via the signal control switches, while the other of the first and second input terminals is connected to ground.

It is an advantage of the present disclosure, that in some embodiments, the sequential pulses, including the first sequence of pulses and the second sequence of pulses, have an energy density or power corresponding to the loss present in the antenna resonator, or in the oscillator circuitry. The energy density of the driving circuit output may be configured to counter the loss present in the antenna resonator or in the oscillator circuitry. The energy density of the driving circuit output may be configured to ensure continuous oscillation of the antenna resonator. The energy density of the driving circuit output may be configured to balance, such as to off-set, a loss in the antenna resonator and/or in the oscillator circuitry. The energy density of the driving circuit output may be of a same or similar magnitude as the loss in the antenna resonator or the oscillator circuitry. The energy density of the driving circuit output may be of a same or similar magnitude, such as 10% higher than the loss in the antenna resonator or the oscillator circuitry.

It is an advantage of the present disclosure, in some embodiments, that maximum antenna resonator voltage may be controlled by controlling pulse width and/or amplitude of the first sequence of pulses and the second sequence of pulses.

It is an advantage of the present disclosure, in some embodiments, that the antenna resonator may be driven with an ability to adjust maximum resonator voltage and the amount of energy pumped into the resonator.

A corresponding antenna resonator receiver may be provided within the near-field, such as within the magnetic near-field, of the antenna resonator transmitting an electromagnetic field, i.e. within the near-field of an antenna resonator transmitter for receiving the transmitted electromagnetic field.

In some embodiments, a first hearing instrument comprising an antenna resonator as herein described may be provided at a first ear of a user and may communicate via the antenna resonator with a second hearing instrument, such as a second hearing instrument provided at a second ear of a user, comprising a corresponding antenna resonator for receiving the transmitted electromagnetic field. The clock generator as provided in the wireless communication unit at the first ear of a user may be synchronized with a clock generator as provided in a wireless communication unit at the second ear.

It should be emphasized that the hearing instrument may be any hearing instrument, including hearing instruments compensating a hearing loss of a user, hearing instruments providing audio to a user, including headsets, earphones, etc. The hearing instrument may be any hearing instruments having wireless communication capabilities.

The hearing instrument may be a hearing instrument compensating a hearing loss of a user, and the hearing instrument may be any type of hearing instrument, including in-the-ear hearing instruments, completely-in-the-canal hearing instruments, behind-the-ear hearing instruments, receiver-in-the ear hearing instruments, and any combination of such hearing instruments or hearing aids compensating a hearing loss of a user. The hearing instrument may furthermore be a headset, such as a headset or set of earphones having on-the-ear earphones, particularly such as a headset or earphones being configured to be arranged in or at the ear of a user. The wireless communication unit may be configured to communicate with another hearing instrument, such as another hearing instrument provided at another ear of a user; the wireless communication unit may be configured to communicate with accessory devices for the hearing instruments, such as including remote controls, spouse microphones, etc.; the wireless communication unit may be configured to communicate with other wearable electronic devices, such as including smart watches, etc. and any combination of these.

In the following the embodiments are described primarily with reference to a hearing instrument, such as a hearing aid. The hearing aid may be a binaural hearing aid. It is however envisaged that any embodiments or elements as described in connection with any one aspect may be used with any other aspects or embodiments, mutatis mutandis.

BRIEF DESCRIPTION OF THE DRAWINGS

The above and other features and advantages will become readily apparent to those skilled in the art by the following detailed description of exemplary embodiments thereof with reference to the attached drawings, in which.

Figure 1:
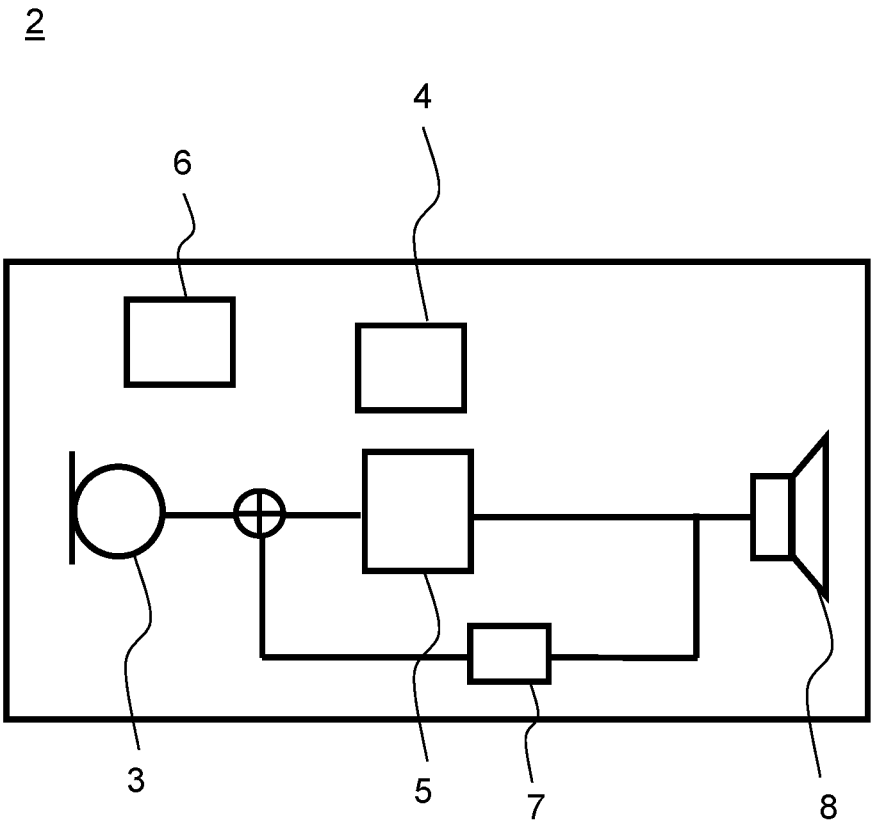
FIG. 1 shows a block-diagram of an exemplary hearing instrument according to the present disclosure.

The claimed invention may, however, be embodied in different forms and should not be construed as limited to the embodiments set forth herein.

DETAILED DESCRIPTION

Various embodiments are described hereinafter with reference to the figures. It should be noted that the figures are not drawn to scale and that elements of similar structures or functions are represented by like reference numerals throughout the figures. It should also be noted that the figures are only intended to facilitate the description of the embodiments. They are not intended as an exhaustive description of the invention or as a limitation on the scope of the invention. In addition, an illustrated embodiment needs not have all the aspects or advantages shown. An aspect or an advantage described in conjunction with a particular embodiment is not necessarily limited to that embodiment and can be practiced in any other embodiments even if not so illustrated, or if not so explicitly described.

A block-diagram of a typical (prior-art) hearing instrument 2 is shown in FIG. 1. The hearing instrument 2 comprises a first transducer, i.e. microphone 3, for receiving incoming sound and converting it into an audio signal, i.e. a first audio signal. The first audio signal is provided to a signal processor 5. In some embodiments, the signal processor is configured for processing the first audio signal into a second audio signal compensating a hearing loss of a user of the hearing instrument. A receiver or speaker 8 is connected to an output of the signal processor 5 for converting the second audio signal into an output sound signal, such as for example a signal modified to compensate for a user's hearing impairment, such as for example a noise reduced signal, etc., and provides the output sound to the speaker 8. Typically, the receiver 8 comprises a transducer, and the receiver 8 may be referred to as speaker 8.

Thus, the hearing instrument signal processor 5 comprises elements such as amplifiers, compressors and noise reduction systems etc. The hearing instrument or hearing aid may further have a filter function 7, such as compensation filter for optimizing the output signal. The hearing instrument may furthermore have a wireless communication unit 4 for wireless data communication configured for emission and reception of an electromagnetic field. The wireless communication unit 4 connect to the hearing instrument signal processor 5, for communicating with external devices, such as with another hearing instrument, such as with another hearing instrument located at another ear, such as for example in a binaural hearing instrument system. The hearing instrument 2 further comprises a power source 6, such as a battery 6.

Figure 2:
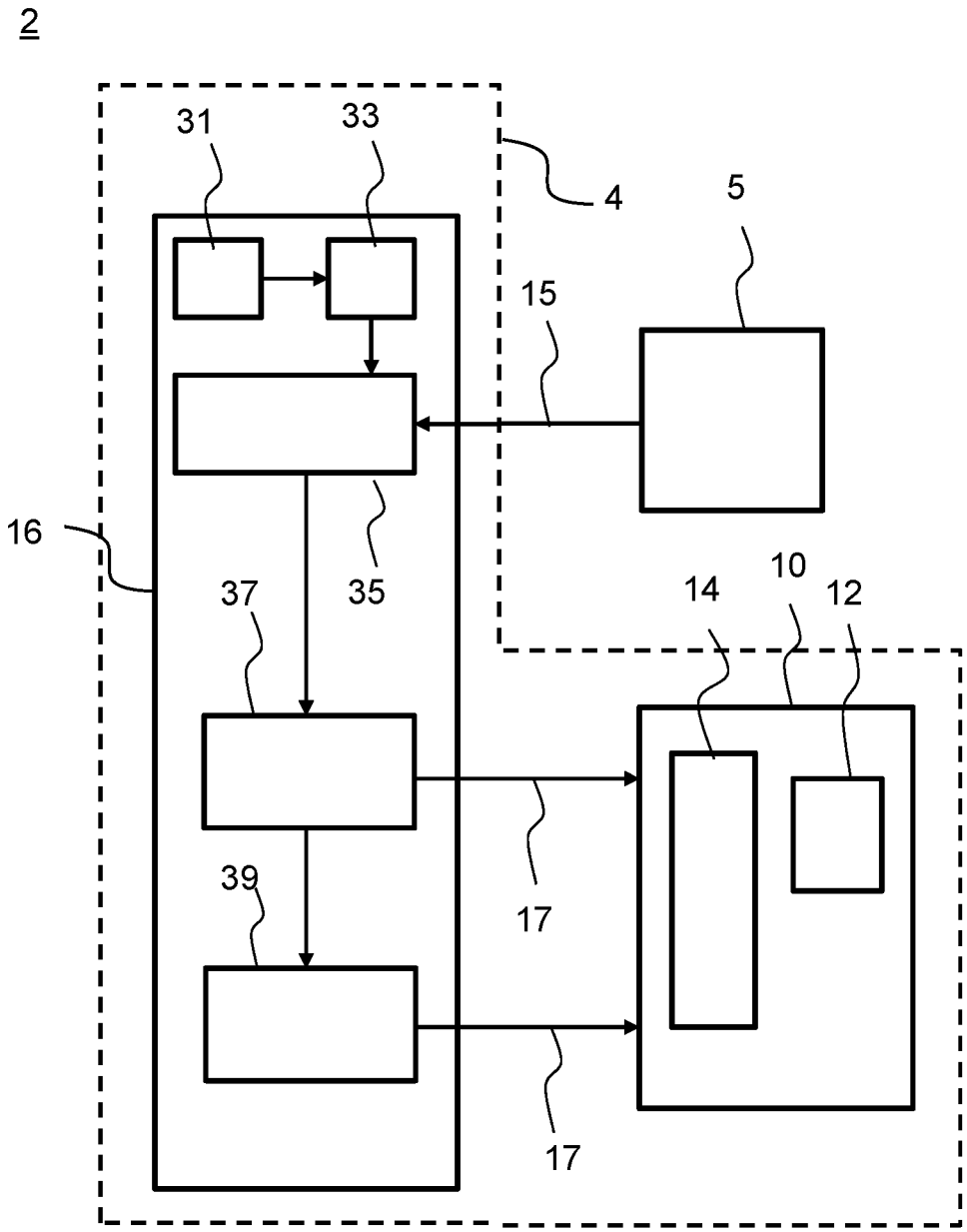
FIG. 2 shows schematically a wireless communication unit according to the present disclosure.

FIG. 2 shows schematically a hearing instrument 2 comprising a wireless communication unit 4 and a signal processor 5. The wireless communication unit 4 is connected to the signal processor 5 for wireless communication. The wireless communication unit 4 is configured to inductively transmit and receive an electromagnetic field. The wireless communication unit comprises an oscillator circuitry 10 comprising an antenna resonator 12 and signal control switches 14. The antenna resonator is configured to emit an electromagnetic field at a first frequency. The wireless communication unit 4 further comprises a driving circuit 16 for driving the oscillator circuitry 10. The driving circuit 16 provides a driving circuit output 17 comprising a first sequence of pulses 18 (see FIG. 7), the first sequence of pulses 18 having a first phase and a first pulse width 25 (see FIG. 7), and a second sequence of pulses 19 (see FIG. 7), the second sequence of pulses 18 having a second phase and a second pulse width 25, the second phase being phase shifted with respect to the first phase. The first phase and the second phase are determined based on the first frequency. The driving circuit output 17, including the first sequence of pulses 18 and the second sequence of pulses 19, is provided to the oscillator circuitry 10 to supply power to the antenna resonator 12 for excitation of the antenna resonator.

The driving circuit 16 comprises clock generator 31, pulse generator 33 and modulator 35 to modulate the incoming data signal. The modulator output comprises a sequence of pulses and is provided to splitter 37 to provide a first output and a second output, wherein the first output of the splitter 37 is provided as first driving circuit output 17 comprising a first sequence of pulses 18, and the second output of splitter 37 is provided to phase shifter 39 configured to shift the phase of the second output. The phase shifted second output of splitter 37 is provided as second driving circuit output 17 comprising a second sequence of pulses 19. The driving circuit output 17 comprises a signal representing data and carrier frequency.

Figure 3:
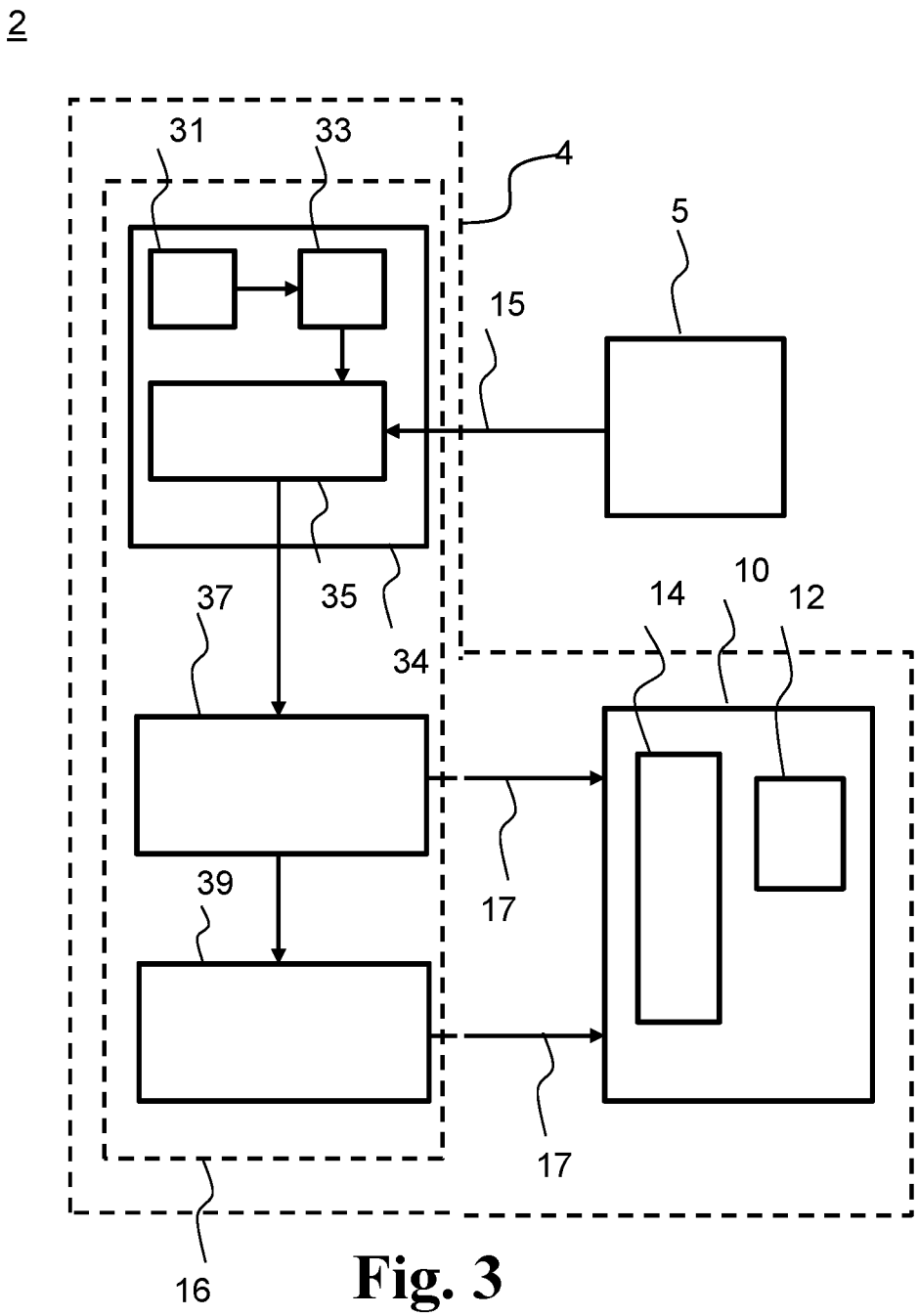
FIG. 3 shows schematically another exemplary wireless communication unit according to the present disclosure.

FIG. 3 shows schematically a hearing instrument 2 comprising a wireless communication unit 4 and a signal processor 5. Same reference numerals refer to same features as in FIG. 2. In FIG. 3, a modulating unit 34 is provided comprising the clock generator 31, pulse generator 33 and modulator 35 configured to modulate the data signal 15. The splitter 37 and the phase shifter 39 is provided separately from the modulating unit. It is envisaged that the components of the modulating unit 34 may be provided as an integrated circuit, such as provided as part of an IC chip. The splitter 37 and the phase shifter 39 may, as seen in FIG. 2, be provided with the modulating unit 34, such as at a same IC chip. However, it is envisaged, as seen in FIG. 3, that the splitter 37 and phase shifter 39 may be provided separately from e.g. an IC chip comprising the modulating unit 34. The modulating unit 34, the splitter 37 and the phase shifter 39 may be provided at a same printed circuit board in the hearing instrument. In some embodiments also the oscillating circuit 10 and the signal processor 5 may be provided on the same printed circuit board. Alternatively, the modulating unit 34, the splitter 37 and the phase shifter 39, and possibly also the oscillating circuit 10 and signal processor 5 may be provided at a number of different printed circuit boards in the hearing instrument or in the wireless communication unit 4.

It should be emphasized that in some embodiments, the splitter 37 and the phase shifter 39 may be dispensed with so that a single driving circuit output 17 is provided comprising a first sequence of pulses 18.

Figure 4:
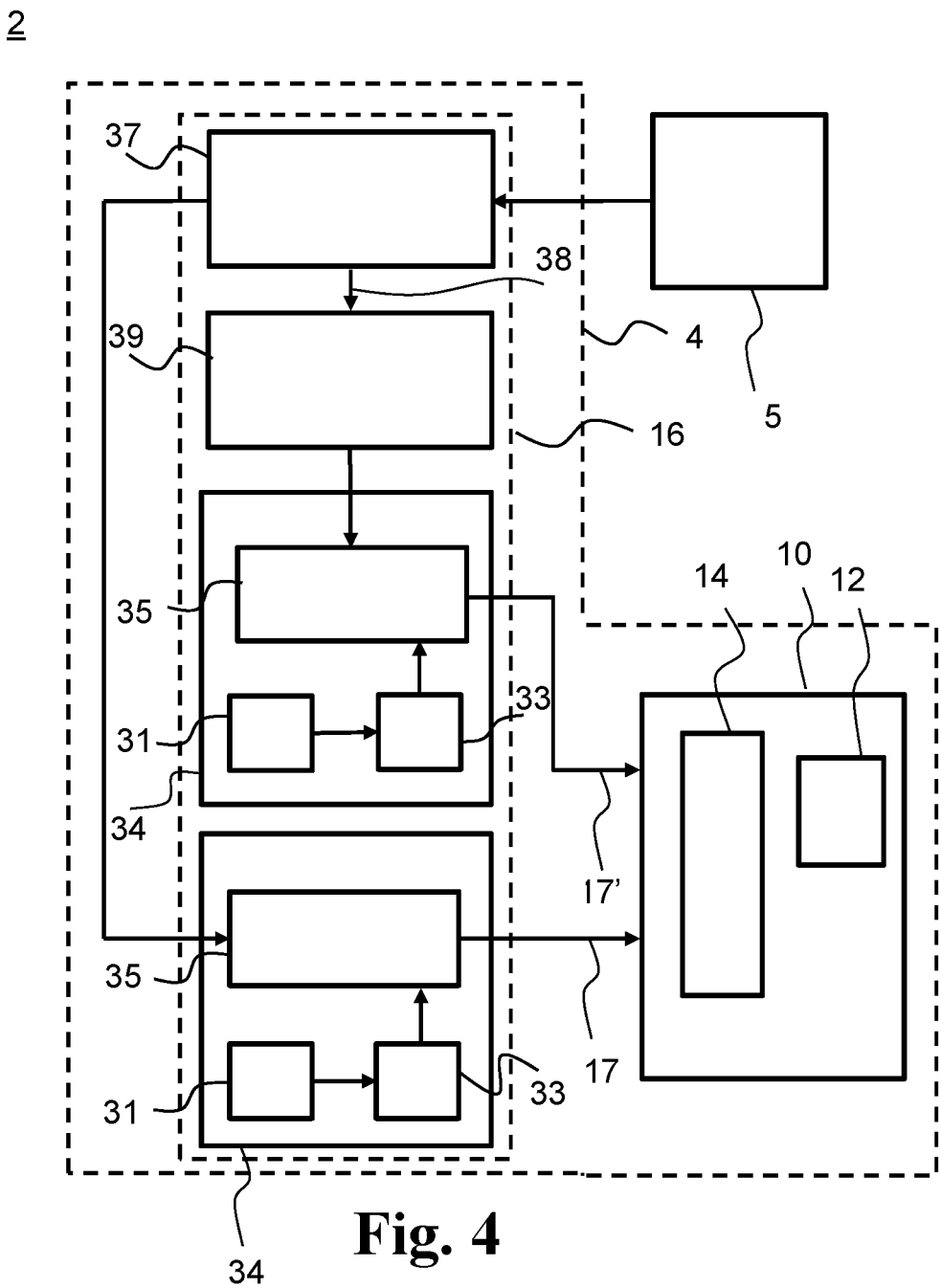
FIG. 4 shows schematically a further exemplary wireless communication unit according to the present disclosure.

FIG. 4 shows schematically a hearing instrument 2 comprising a wireless communication unit 4 and a signal processor 5. Same reference numerals refer to same features as in FIG. 2. In FIG. 4, another implementation of a wireless communication unit according to the present disclosure is shown. A splitter 37 receives the signal from the signal processor 5, and splits the signal into a first signal 36 and a second signal 38. The first signal 36 is provided to a first modulating unit 34 comprising clock generator 31, pulse generator 33 and modulator 35 for modulating of the first signal 36, whereas the second signal 38 is provided to phase shifter 39 for phase shifting of the second signal 38. The phase shifted second signal is provided to second modulating unit 34' comprising clock generator 31, pulse generator 33 and modulator 35 for modulating of the phase shifted second signal. The output 17 of the first modulating unit 34 and the output 17' of the second modulating unit 34' are provided as driving circuit output 17, 17' to the oscillating circuit 10.

It should be emphasized that splitter 37 and phase shifter 39 may be implemented using any methods and components as will be known to a skilled person. Thus, the splitter 37 and phase shifter 39 will not be described in further detail.

Figure 5A:
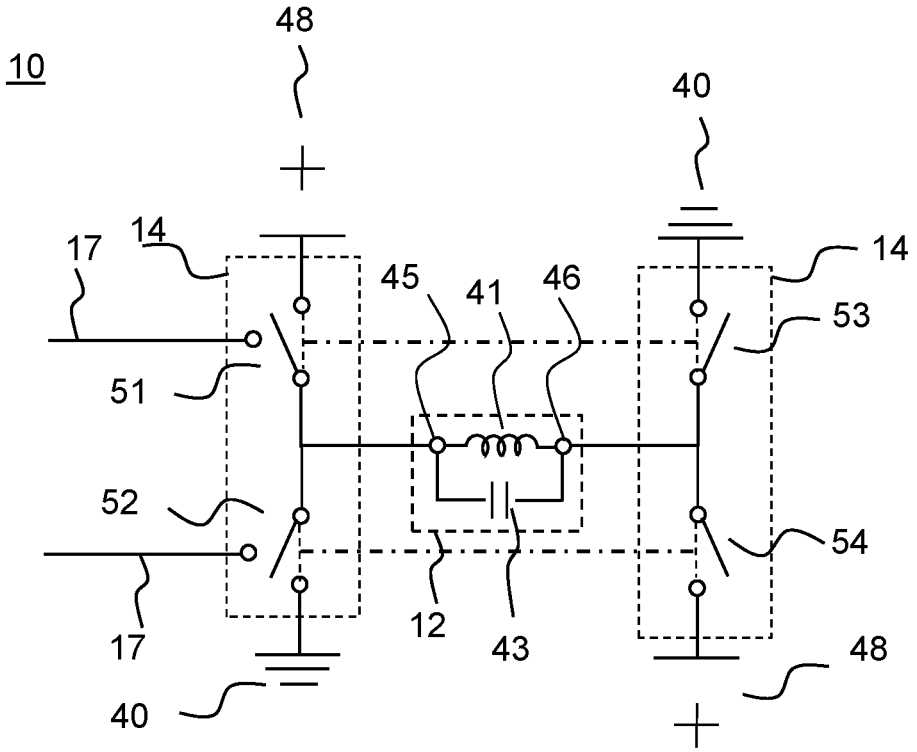
FIGS. 5*a* and 5*b* show schematically oscillating circuits comprising signal control switches.
Figure 5B:
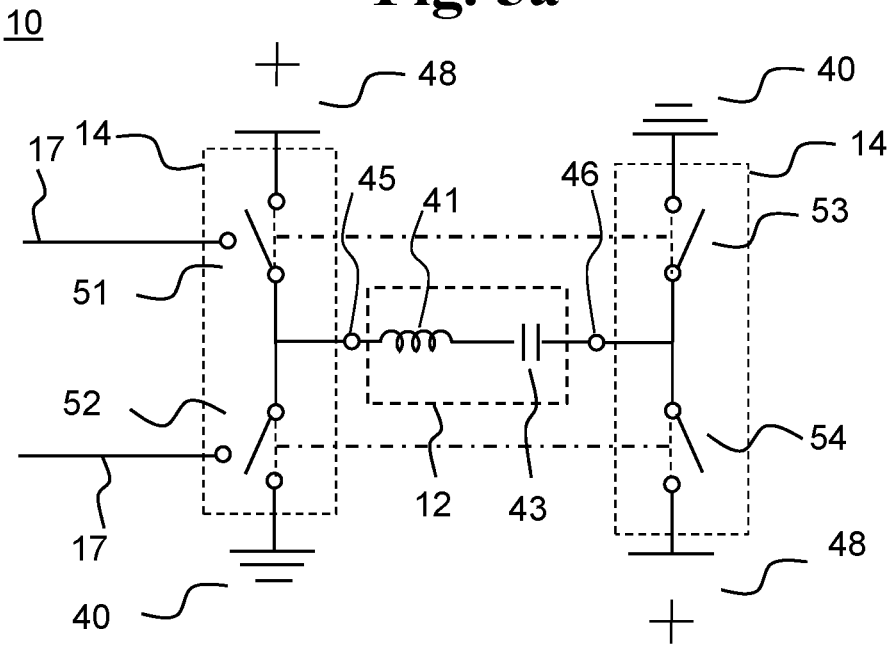

FIGS. 5*a* and 5*b* show schematically oscillating circuits 10 comprising signal control switches 14 and antenna resonators 12.

In FIG. 5*a*, the oscillating circuit 10 is shown in more detail. The oscillating circuit comprises antenna resonator 12 and signal control switches 14. The antenna resonator 12 comprises an inductor 41 and a capacitor 42. Even though the inductor 41 and capacitor 42 are shown as single inductor and capacitor components, it should be emphasized that the antenna resonator comprising at least an inductor and a capacitor may be implemented in any known way, including using a number of components to obtain a preferred antenna resonator. In the present example, it is seen that the antenna resonator is implemented with a parallel coupled inductor and capacitor. The antenna resonator has a first input terminal 45 and a second input terminal 46. The first input terminal 45 is provided at a first side of the antenna resonator 12, and the second input terminal 46 is provided at a second side of the antenna resonator 12.

The switching control switches 14 are supplied with power at supply 48. The power is supplied from a power source 6 of the wireless communication unit, such as from a power source 6 of the hearing instrument, such as from a battery 6. The switching control switches are connected to ground 40, such as to a ground potential of a printed circuit board (not shown). The switching control switches comprise first, second, third and fourth control switches 51, 52, 53, 54. It is seen that at the first side of the antenna resonator 12, there is a potential difference over first control switch 51 and second control switch 52. Likewise, on the second side of the antenna resonator 12, there is a potential difference over the third control switch 53 and the fourth control switch 54. The driving circuit output is provided to the switching control switches. A first driving circuit output 17 comprising the first sequence of pulses 18 is provided to first control switch 51 and to third control switch 53. A second driving circuit output 17' comprising the second sequence of pulses 19 is provided to second control switch 52 and to the fourth control switch 54. The control switches 51, 52, 53 and 54 are configured to close when a pulse is received, that is the control switches are normally open switches and closes when a pulse is received. When a pulse of the first sequence of pulses is received at the first and third control switch 51, 53, the first and third control switches 51, 53 will close thereby creating a potential difference over the antenna resonator and supply power to the antenna resonator. Likewise, when a pulse of the second sequence of pulses is received at the second and fourth control switches 52, 54, the second and fourth control switches 52, 54 will close thereby creating a potential difference having opposite sign with respect to the potential difference created at the receipt of a pulse of the first sequence of pulses and supply power with opposite sign to the antenna resonator. Thus, upon receiving the first and second sequence of pulses 18, 19, an alternating voltage will be supplied to the antenna resonator to thereby excite the antenna resonator.

In FIG. 5*b*, another oscillating circuit 10 according to the present disclosure is shown. Same reference numerals refer to same features as in FIG. 5*b*. The oscillating circuit comprises antenna resonator 12 and signal control switches 14. The antenna resonator 12 is seen to comprise an inductor 41 and a capacitor 42. In the present embodiment, it is seen that the antenna resonator is implemented with inductor and capacitor coupled in series. The antenna resonator has a first input terminal 45 and a second input terminal 46. The first input terminal 45 is provided at a first side of the antenna resonator 12, and the second input terminal 46 is provided at a second side of the antenna resonator 12. The further implementation is as set out above for FIG. 5*a*.

Figure 6A:
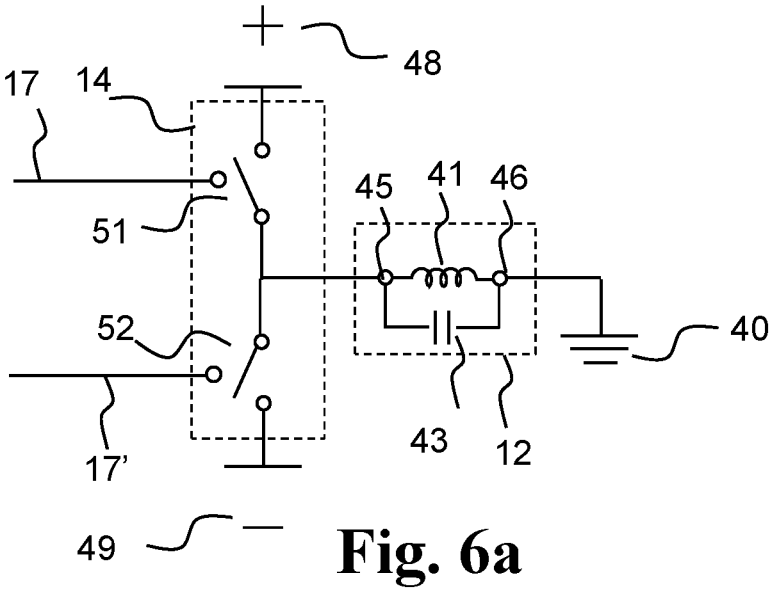
FIGS. 6*a* and 6*b* show schematically other exemplary oscillating circuits.
Figure 6B:
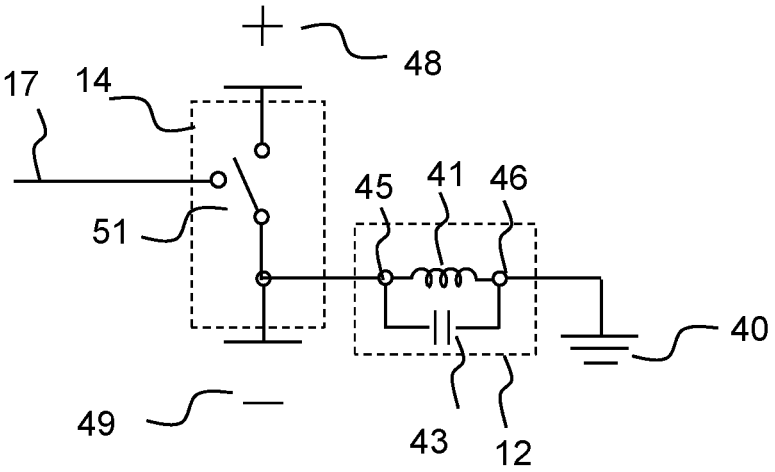

In FIGS. 6*a* and 6*b*, further oscillating circuits 10 according to the present disclosure is shown. Same reference numerals refer to same features as in FIGS. 5*a* and 5*b*.

In FIG. 6*a*, the oscillating circuit 10 comprises antenna resonator 12 and signal control switches 14. The antenna resonator 12 is seen to comprise an inductor 41 and a capacitor 42. In the present embodiment, it is seen that the antenna resonator is implemented as parallel coupled inductor 41 and capacitor 42. The antenna resonator has a first input terminal 45 and a second input terminal 46. The first input terminal 45 is provided at a first side of the antenna resonator 12, and the second input terminal 46 is provided at a second side of the antenna resonator 12. The driving circuit output is provided to the switching control switches. A first driving circuit output 17 comprising the first sequence of pulses 18 is provided to first control switch 51. A second driving circuit output 17' comprising the second sequence of pulses 19 is provided to second control switch 52. First and second control switches 51, 52 are connected to the first input terminal 45 of the antenna resonator 12. The second input terminal 46 of the antenna resonator 12 is connected to ground 40. The control switch 51 will when closed connect the first input terminal 45 to power supply potential 48. The control switch 52 will when closed connect the first input terminal 45 to negative supply power 49. The control switches 51, 52 are configured to close when a pulse is received, that is the control switches are normally open switches and closes when a pulse is received. When a pulse of the first sequence of pulses is received at the first control switch 51, the first control switch 51 will close thereby creating a potential difference over the antenna resonator and supply power to the antenna resonator. Likewise, when a pulse of the second sequence of pulses is received at the second control switches 52, the second control switch 52 will close thereby creating a potential difference having opposite sign with respect to the potential difference created at the receipt of a pulse of the first sequence of pulses and supply power with opposite sign to the antenna resonator. Thus, upon receiving the first and second sequence of pulses 18, 19, an alternating voltage will be supplied to the antenna resonator to thereby excite, or ensure excitation, of the antenna resonator.

In FIG. 6*b*, another oscillating circuit 10 according to the present disclosure is shown. In FIG. 6*b*, the oscillating circuit 10 comprises antenna resonator 12 and signal control switch 14. The antenna resonator 12 is seen to comprise an inductor 41 and a capacitor 42. In the present embodiment, it is seen that the antenna resonator is implemented as parallel coupled inductor 41 and capacitor 42. The antenna resonator has a first input terminal 45 and a second input terminal 46. The first input terminal 45 is provided at a first side of the antenna resonator 12, and the second input terminal 46 is provided at a second side of the antenna resonator 12. The driving circuit output is provided to the switching control switch 14 comprising control switch 51. The driving circuit output 17 comprising a sequence of pulses 18 is provided to the control switch 51. The control switch 51 is connected to the first input terminal 45 of the antenna resonator 12. The second input terminal 46 of the antenna resonator 12 is connected to ground 40. The control switch 51 will when closed connect the first input terminal 45 to power supply potential 48. The control switch 51 will when open connect the first input terminal 45 to negative supply power 49 or to ground 40 (not shown). The control switch 51 is configured to close when a pulse is received, that is the control switch is a normally open switch and closes when a pulse is received. When a pulse of the first sequence of pulses is received at the first control switch 51, the first control switch 51 will close thereby creating a potential difference over the antenna resonator and supply power to the antenna resonator. Thus, upon receiving the sequence of pulses 18, a voltage will be supplied to the antenna resonator to thereby excite, or ensure excitation, of the antenna resonator using short pulse excitation.

Figure 7:
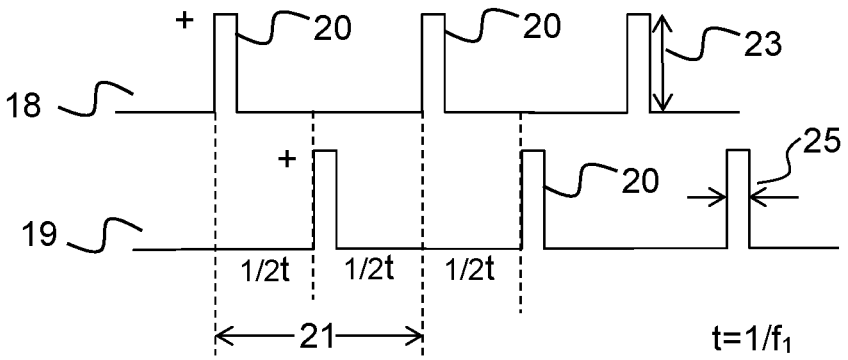
FIG. 7 illustrates a driving circuit output.

FIG. 7 illustrates a driving circuit output comprising a first sequence of pulses 18 and a second sequence of pulses 19. The pulses in the second sequence of pulses 19 are phase shifted 180 degrees with respect to the pulses in the first sequence of pulses 18. The period 21 of the pulses is $t=1/f_1$. The distance between a first flange of a pulse in the first sequence of pulses and a first flange of a pulse in the second sequence of pulses is ½ t. The amplitude 23 of the pulses is given by the height of the pulses. The pulse width 25 of the pulses is given by the width of the pulses. In the embodiment illustrated, the pulse width 25 of the pulses in the first and second sequence of pulses 18, 19 is constant and the pulse width of the pulses in the first sequence of pulses corresponds to the pulse width of the pulses in the second sequence of pulses. Likewise, in the embodiment illustrated, the amplitude 23 of the pulses 20 in the first and second sequence of pulses 18, 19 is constant and the amplitude 23 of the pulses 20 in the first sequence of pulses 18 corresponds to, such as is equal to, such as is substantially equal to, the amplitude 23 of the pulses 20 in the second sequence of pulses 19.

It should be emphasized that the pulse width and the amplitude may vary and still be considered constant and corresponding within the meaning of the present disclosure, for example if the variation is less than 10%. The amplitude of the pulses in the first and second sequence of pulses may control whether the switches 51, 52, 53, 54 switches (i.e. closes or opens) upon receipt of the pulse. In some embodiments the amplitude 23 of the pulses 20 in the first and second sequence of pulses is configured to be above a threshold amplitude value, to ensure switching of the switch from open to close or vice versa.

The hearing instrument may be a behind-the ear hearing instrument, and may be provided as a behind-the-ear module, the hearing instrument may be an in-the-ear module and may be provided as an in-the-ear module.

Alternatively, parts of the hearing instrument may be provided in a behind-the-ear module, while other parts, such as the receiver, may be provided in an in-the-ear module.

Although particular embodiments have been shown and described, it will be understood that it is not intended to limit the claimed inventions to the preferred embodiments, and it will be obvious to those skilled in the art that various changes and modifications may be made without department from the spirit and scope of the claimed inventions. The specification and drawings are, accordingly, to be regarded in an illustrative rather than restrictive sense. The claimed inventions are intended to cover alternatives, modifications, and equivalents.

The invention claimed is:

1. A hearing instrument comprising:

a microphone configured to convert sound into a first audio signal;

a signal processor configured to provide a second audio signal compensating a hearing loss of a user of the hearing instrument based on the first audio signal;

a speaker configured to provide an output sound signal based on the second audio signal; and a wireless communication unit comprising an oscillator circuitry, the oscillator circuitry having an antenna resonator configured to emit an electromagnetic field at a first frequency, wherein the oscillator circuitry also has a driving circuit configured to provide a driving circuit output;

wherein the driving circuit output comprises:

a first sequence of pulses having a first phase and a first pulse width, and a second sequence of pulses having a second phase and a second pulse width, the second phase being phase shifted with respect to the first phase, the first phase and the second phase being based on the first frequency; and wherein the oscillator circuitry is configured to obtain the first sequence of pulses and the second sequence of pulses for excitation of the antenna resonator.

2. The hearing instrument according to claim 1, wherein the second phase is phase shifted 180° with respect to the first phase.

3. The hearing instrument according to claim 1, wherein the first pulse width and the second pulse width are fixed pulse widths, and/or wherein the first pulse width and the second pulse width are based on the first frequency.

4. The hearing instrument according to claim 1, wherein the antenna resonator is a magnetic induction antenna.

5. The hearing instrument according to claim 1, wherein the first sequence of pulses has a first period, and the second sequence of pulses has a second period, and wherein each of the first period and the second period is a fraction of an inverse of the first frequency.

6. The hearing instrument according to claim 5, wherein the fraction is between one hundredth and one fourth.

7. The hearing instrument according to claim 1, wherein an energy density of the driving circuit output is based at least partly on the first pulse width and the second pulse width, and/or on an amplitude of the first sequence of pulses and an amplitude of the second sequence of pulses.

8. The hearing instrument according to claim 1, wherein the pulses in the first sequence of pulses have a first constant amplitude, and wherein the pulses of the second sequence of pulses have a second constant amplitude.

9. The hearing instrument according to claim 8, wherein the first constant amplitude and the second constant amplitude are the same.

10. The hearing instrument according to claim 1, wherein the antenna resonator comprises an inductor and a capacitor coupled in parallel.

11. The hearing instrument according to claim 1, wherein the antenna resonator comprises an inductor and a capacitor provided in series.

12. The hearing instrument according to claim 1, wherein the first frequency is between 1 MHz to 20 MHz.

13. The hearing instrument according to claim 1, wherein the antenna resonator has a first input terminal and a second input terminal, and wherein the hearing instrument comprises signal control switches configured to provide the driving circuit output to the first input terminal and the second input terminal.

14. The hearing instrument according to claim 1, wherein the hearing instrument is configured to be worn by the user, and the oscillator circuitry is a part of the hearing instrument that is configured to be worn by the user.

15. A method of operating a hearing instrument, the hearing instrument comprising a microphone configured to provide a first audio signal, a signal processor configured to provide a second audio signal compensating a hearing loss of a user of the hearing instrument based on the first audio signal, a speaker configured to provide an output sound signal based on the second audio signal, a wireless communication unit comprising an oscillator circuitry having an antenna resonator, the antenna resonator being configured to transmit an electromagnetic field at a first frequency, and a driving circuit for the oscillator circuitry, the method comprising:

generating by the driving circuit a driving circuit output; and providing the driving circuit output to the oscillator circuitry to supply power to the antenna resonator for excitation of the antenna resonator;

wherein the driving circuit output comprises:

a first sequence of pulses having a first phase and a first pulse width, and a second sequence of pulses having a second phase and a second pulse width, the second phase being phase shifted with respect to the first phase, the first phase and the second phase being based on the first frequency.

16. The method according to claim 15, wherein the second phase is phase shifted 180° with respect to the first phase.

17. The method according to claim 15, wherein the first pulse width and the second pulse width are fixed pulse widths, and/or wherein the first pulse width and the second pulse width are based on the first frequency.

18. The method according to claim 15, wherein the antenna resonator is a magnetic induction antenna.

19. The method according to claim 15, wherein the first sequence of pulses has a first period, and the second sequence of pulses has a second period, and wherein each of the first period and the second period is a fraction of an inverse of the first frequency.

20. The method according to claim 15, wherein the hearing instrument is configured to be worn by the user, and the oscillator circuitry is a part of the hearing instrument that is configured to be worn by the user.

* * * * *